US006923557B2

(12) United States Patent
Jahn et al.

(10) Patent No.: US 6,923,557 B2
(45) Date of Patent: Aug. 2, 2005

(54) MODULAR LIGHTING ASSEMBLY

(75) Inventors: Herb Jahn, Scarborough (CA); Perry Rizzo, Bradford (CA); Rocco Di Serio, Scarborough (CA)

(73) Assignee: Lightshapes Inc., Aurora (CA)

( * ) Notice: Subject to any disclaimer, the term of this patent is extended or adjusted under 35 U.S.C. 154(b) by 52 days.

(21) Appl. No.: 10/690,269

(22) Filed: Oct. 21, 2003

(65) Prior Publication Data

US 2005/0083691 A1 Apr. 21, 2005

(51) Int. Cl.[7] ..... F21V 21/005
(52) U.S. Cl. ..... 362/249; 362/238; 362/252
(58) Field of Search ..... 362/249, 238, 362/239, 250, 252, 364–367

(56) References Cited

U.S. PATENT DOCUMENTS 5,660,461 A * 8/1997 Ignatius et al. ..... 362/241

* cited by examiner

*Primary Examiner*—Sandra O'Shea
*Assistant Examiner*—Mark Tsidulko
(74) *Attorney, Agent, or Firm*—Tarolli, Sundheim, Covell & Tummino L.L.P.

(57) ABSTRACT

A modular lighting assembly is formed from a plurality of modules. Each module comprises a base having an outer edge and a sidewall coupled to the outer edge of the base. The sidewall surrounds the base to provide a recess. A socket for receiving a light bulb is coupled to the base and extends into the recess. At least one locking device is provided on the sidewall to allow the module to be coupled to another module to provide a modular lighting assembly.

21 Claims, 11 Drawing Sheets

FIG. 5.
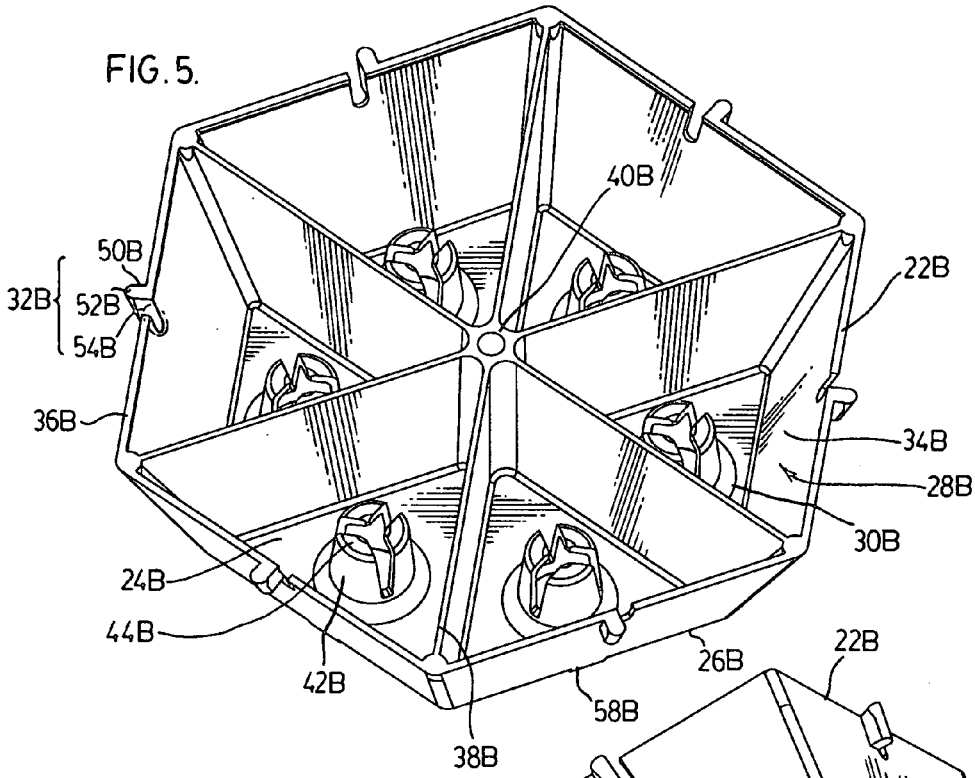
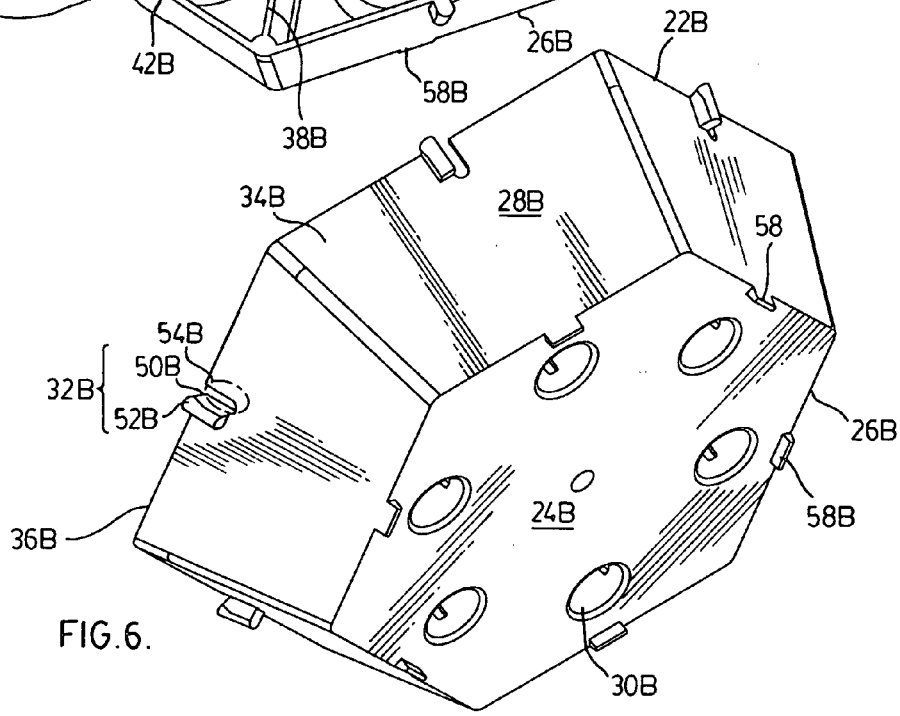
FIG. 6.

FIG. 8.
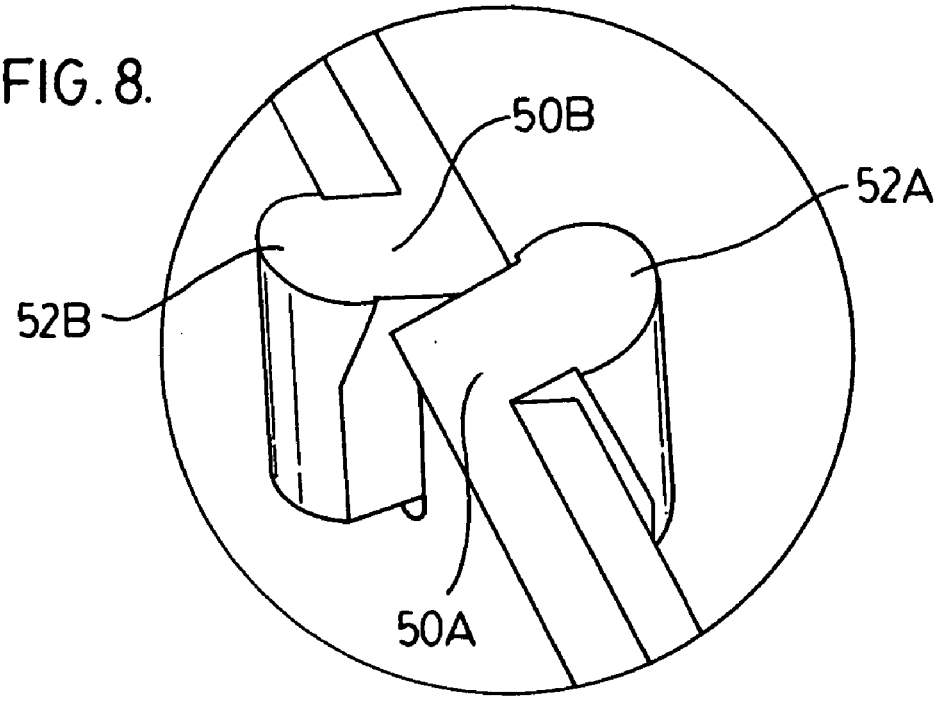
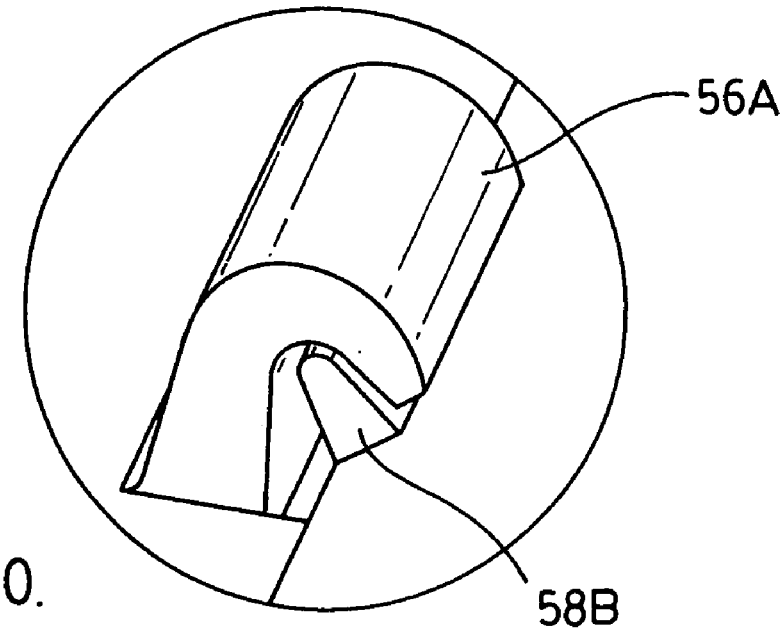
FIG. 10.

MODULAR LIGHTING ASSEMBLY

FIELD OF THE INVENTION

The present invention relates to modular lighting assemblies, in particular, a novel locking system for coupling individual modules to one another to provide a modular lighting assembly.

BACKGROUND OF THE INVENTION

Decorative lighting products for assembly by the customer have been available on the market for some time. These products typically include several individual lighting units that are assembled to produce a final decorative lighting arrangement. The individual lighting units can be assembled in various different ways to produce lighting assemblies having different shapes.

The prior art lighting products suffer from many different disadvantages. For example, these products are generally fragile or lack strength or toughness. Many of these devices can not be disassembled after assembly. Also a very limited number of shapes are available or can be constructed using these prior art products. Further, the removal or changing of light bulbs is difficult in these products.

It is therefore desirable to provide an improved decorative lighting product that obviates or mitigates at least some of the disadvantages of the prior art.

SUMMARY OF THE INVENTION

According to an aspect of the present invention there is provided a module having a base with an outer edge. A sidewall is coupled to the outer edge of the base and the sidewall surrounds the base to provide a recess. A socket is coupled to the base for receiving a light bulb. At least one locking device is provided on the sidewall and is configured to couple with a complementary locking device of a second module to couple the module with the second module and thereby provide a modular lighting assembly.

According to another aspect of the present invention there is provided a modular lighting assembly including a plurality of modules coupled together. Each module has a base with an outer edge. A sidewall is coupled to the outer edge of the base and surrounds the base to provide a recess. A socket is coupled to the base for receiving a light bulb and at least one locking device is provided on the sidewall. The locking device is configured for coupling with a complementary locking device of another of the plurality of modules.

Advantageously, the modules of the modular lighting assembly are robust and can be easily assembled and disassembled. Because of the number of possible shapes, the lighting assembly can be assembled into a variety of different shapes. Also, light bulbs are easily removed and changed when desired. In another advantage, the slope and size of the socket allows for the use of a variety of different mini-light string types. Thus, the modular lighting assembly permits the use of mini-light strings from a variety of manufacturers.

BRIEF DESCRIPTION OF THE DRAWINGS

Embodiments of the present invention will now be described more fully with reference to the accompanying drawings in which like reference numerals represent like parts:

FIG. 5 is a perspective view of another one of the modules of FIG. 1;

FIG. 6 is an alternative perspective view of the module of FIG. 5;

FIG. 8 is a perspective view of two interconnected locking devices of the sub-assembly of FIG. 7;

FIG. 10 is a perspective view of a latch engaging a lug of the sub-assembly of FIG. 7;

DETAILED DESCRIPTION OF THE PREFERRED EMBODIMENTS

Figure 1:
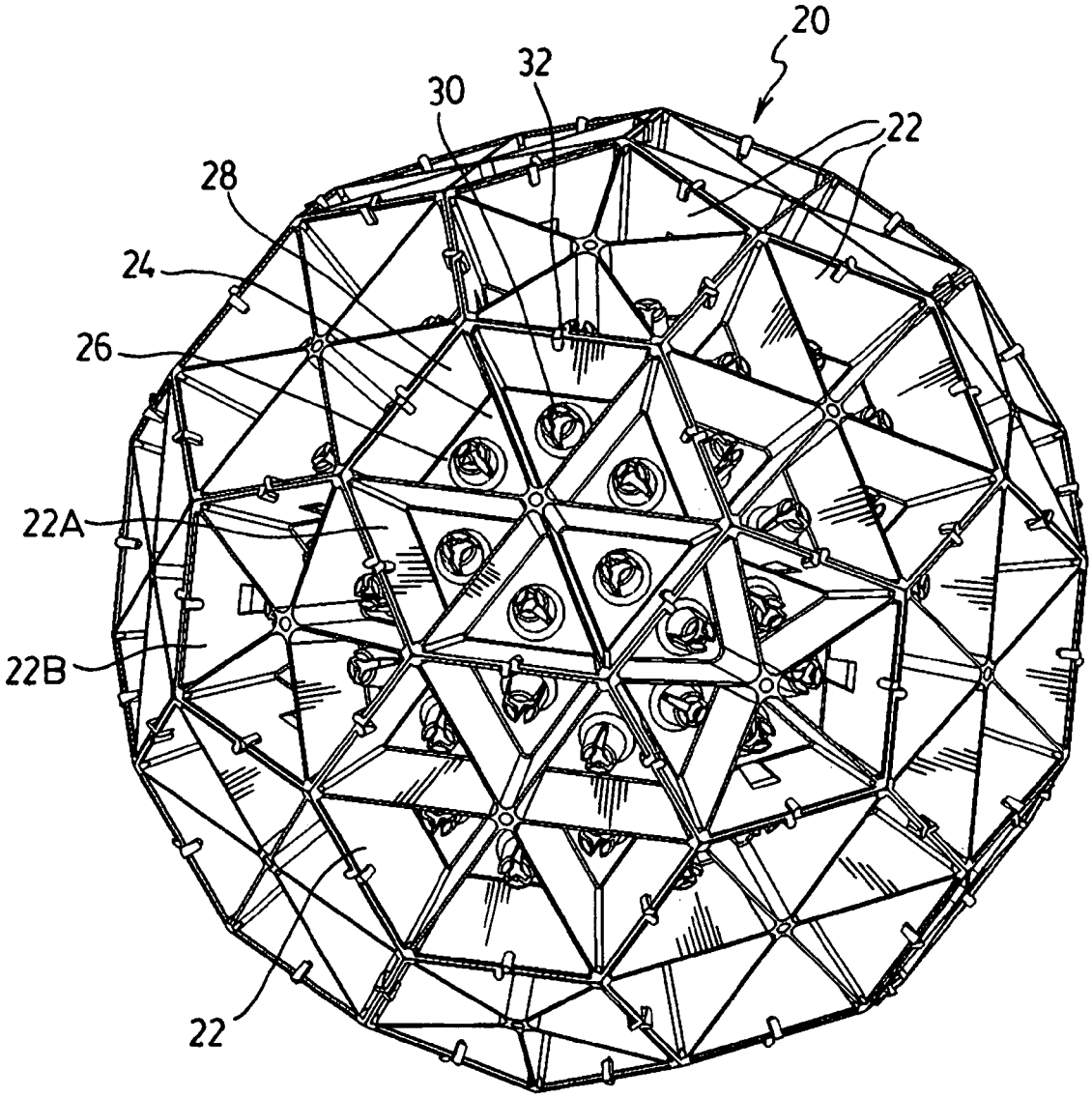
FIG. 1 is a perspective view of a modular lighting assembly including several modules according to an embodiment of the present invention.

Reference is first made to FIG. 1 to describe an embodiment of a modular lighting assembly according to the present invention, indicated generally by the numeral 20. The modular lighting assembly 20 includes a plurality of modules 22 coupled together. Each module 22 has a base 24 with an outer edge 26. A sidewall 28 is coupled to the outer edge 26 of the base 24 and surrounds the base 24 to provide a recess. A socket 30 is coupled to the base 24 for receiving a light bulb and at least one locking device 32 is provided on the sidewall 28. The locking device 32 is configured for coupling with a complementary locking device of another of the plurality of modules.

As shown in FIG. 1, the modules 22 of the modular lighting assembly are not all identical. In the present embodiment, a plurality of two different module types 22 are employed to construct the modular lighting assembly 20. The two different module types of the present embodiment are indicated herein by the numerals 22A and 22B for the purpose of clarity. The first module 22A will now be described in more detail with reference to FIG. 2.

The module 22A, which forms part of the modular lighting unit 20, includes the base 24A that is generally flat and pentagonal shaped. Thus, the outer edge 26A of the pentagonal shaped base 24A includes five sides. Five wall portions 34A together form the sidewall 28A that extends from the outer edge 26A of the base 24A, surrounding the base 24A and forming the recess. Clearly, each wall portion 34A extends from a respective one of the five sides of the base 24A to a free side 36A. The free sides 36A of the wall portions 34A together form a pentagonal opening to the recess formed by the sidewall 28A and base 24A. Each wall portion 34A forms an obtuse angle with the base 24A as each wall portion 34A extends outwardly therefrom. Thus, the pentagonal opening formed by the free sides 36A of the wall portions 34A is larger than the pentagonally shaped base 24A. The wall portions 34A permit joining of the modules 22A and 22B in the shape of the modular lighting assembly 20 shown in FIG. 1.

Figure 2:
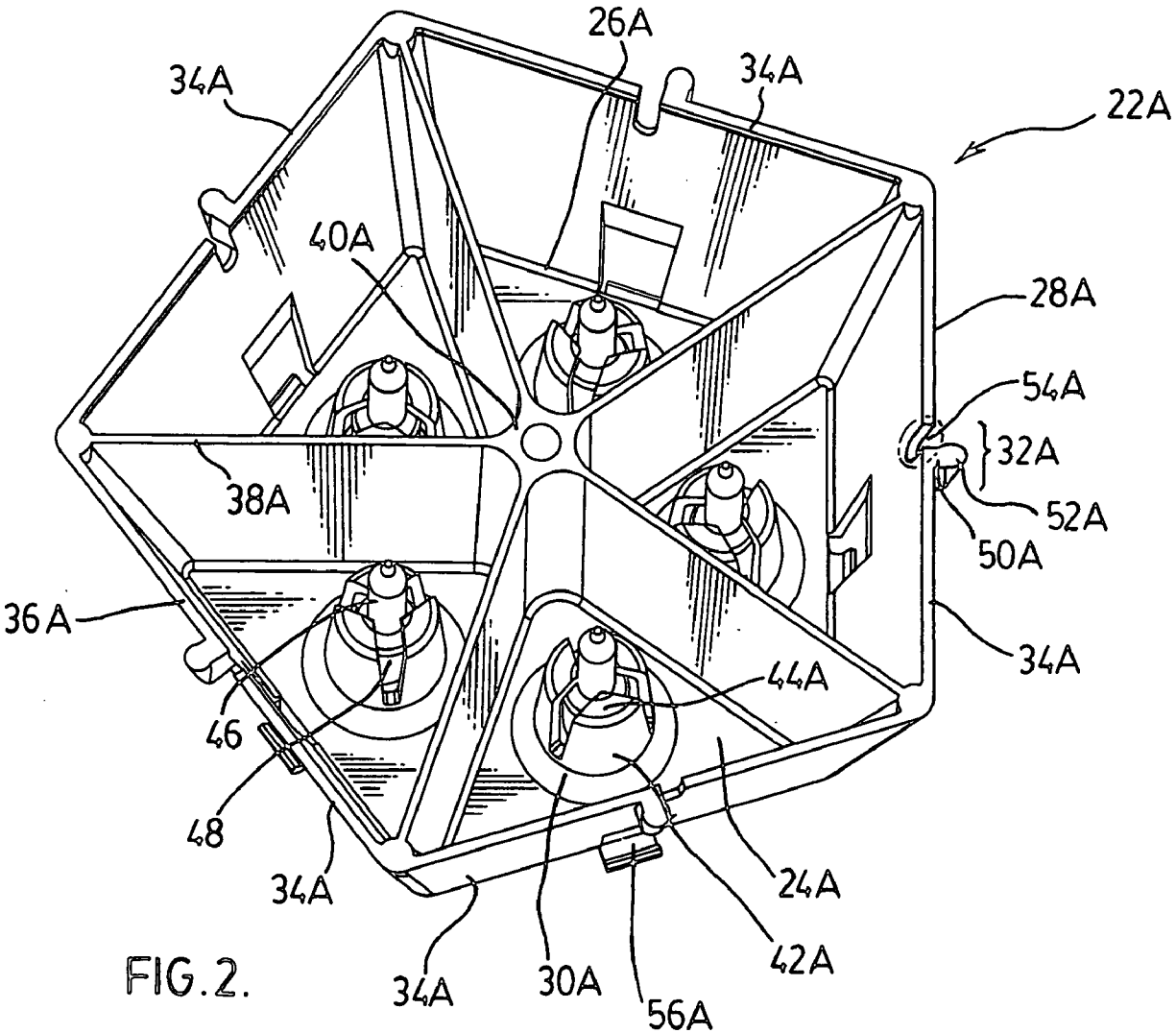
FIG. 2 is a perspective view of one of the modules of FIG. 1.

Referring still to FIG. 2, the module 22A includes five spokes 38A, each extending inwardly from a respective corner of sidewall 28A where wall portions 34A join. The spokes 38A extend inwardly to a central hub 40A. Thus, the recess of the module 22A is divided into five triangular regions, each region being defined by a wall portion 34A and two spokes 38A.

Each of the triangular regions includes the socket 30A that extends from the base 24A into the recess. The socket 30A includes three prongs 42A that extend upwardly from the base 24A and into the recess, and each prong 30A includes an inwardly extending end 44A. The prongs 42A and ends 44A are shaped and configured such that each socket 30A receives a light bulb 46 of a lighting device 48 and the light bulb 46 is grasped by the inwardly extending ends 44A. The lighting device 48 is press fit into the socket 30A with the light bulb 46 extending into the recess and wires of the lighting device 48 extending in the opposite direction from the lighting device 48 (on the opposing side of the base 24A). The wires (not shown) are coupled to a wire harness (also not shown) that is routed internally within the modular lighting assembly 20 of the present embodiment.

Figure 3:
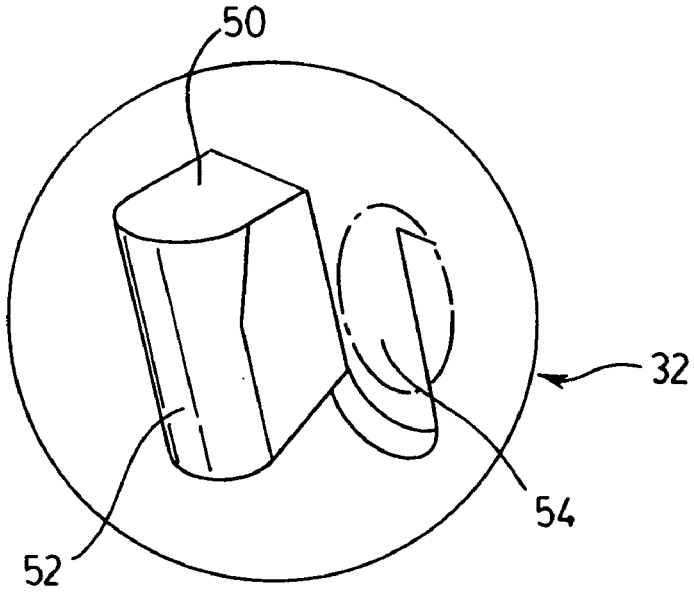
FIG. 3 is a perspective view of a locking device of the module of FIG. 2.

Each of the wall portions 34A includes the locking device 32A, best shown in FIG. 3, for coupling the module 22A with a complementary locking device 34B of a complementary module 22B. The locking device 32A includes a tab 50A that extends outwardly from the wall portion 34A of the modular lighting assembly and has an enlarged locking end 52A. The locking device 32A also includes a slot 54A adjacent the tab 32A, for receiving a tab 32B of the complementary locking device 34B of the complementary module.

Each slot 54A of the module 22A, is sized to provide an interference fit with the tab 50B of the complementary locking device 32B. Also, the enlarged locking end 52A of each tab is wider still than the width of the tab 50A and thus is wider than the width of each slot 50B of the complementary locking device 32B.

Figure 4:
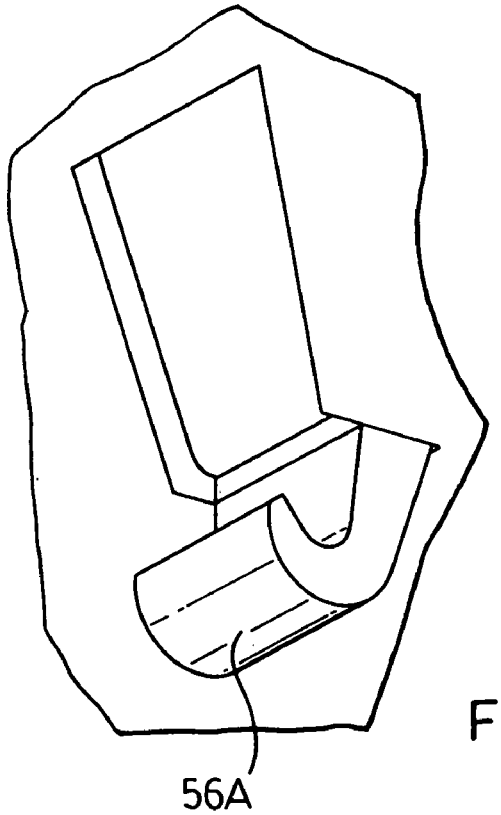
FIG. 4 is a perspective view of a latch of the module of FIG. 1.

The module 22A also includes latches 56A that extend from the base 24A, proximal the outer edge 26A (best shown in FIGS. 2 and 4). Each latch 56A extends from the base, proximal a respective side of the pentagonal base 24A. Each latch 56A is hook-shaped, extending outwardly and is sized for engaging with a portion of the second module 22B.

Reference is now made to FIG. 5 to describe the second module 22B in more detail. As will be appreciated many of the parts of the second module 22B are similar to the parts of the first module 22A and therefore are referred to using the same reference numerals, denoted by the letter B, rather than the letter A.

In the present embodiment, the second module 22B, which forms part of the modular lighting unit 20, includes the generally flat base 24B that is hexagonal shaped, rather than pentagonal shaped (as is the case of the first module 22A). Thus, the outer edge 26B of the hexagonal shaped base 24B includes six sides. Six wall portions 34B together form the sidewall 28B that extends from the outer edge 26B of the base 24B, surrounding the base 24B and forming the recess. Clearly, each wall portion 34B extends from a respective one of the six sides of the base 24B to a free side 36B. The free sides 36B of the wall portions 34B together form a hexagonal opening to the recess formed by the sidewall 28B and base 24B. Each wall portion 34B forms an obtuse angle with the base 24B as each wall portion 34B extends outwardly therefrom. Thus, the hexagonal opening formed by the free sides 36B of the wall portions 34B is larger than the hexagonal shaped base 24B. The wall portions 34B permit joining of the modules 22A and 22B in the shape of the modular lighting assembly 20 shown in FIG. 1.

Referring still to FIG. 5, the module 22B includes six spokes 38B, each extending inwardly from a corner of sidewall 28B where two wall portions 34B join. The spokes 38B extend inwardly to a central hub 40B. Thus, the recess of the module 22B is divided into six triangular regions, each region being defined by a wall portion 34B and two spokes 38B.

Each of the triangular regions includes a socket 30B that extends from the base 24B into the recess. Like the socket 30A, the socket 30B includes three prongs 42B that extend upwardly from the base 24B and into the recess, and each prong 30B includes an inwardly extending end 44B. The prongs 42B and ends 44B are shaped and configured such that each socket 30B receives a light bulb 46 of a lighting device 48 and the light bulb 46 is grasped by the inwardly extending ends 44B.

Each of the wall portions 34B includes the locking device 32B, best shown in FIG. 3, for coupling the second module 22B with the first module 22A (or any other suitable module). In the present embodiment, the locking device 32B of the second module 22B is similar to the locking device 32A of the first module 22A and therefore need not be further described herein.

Referring to FIG. 6, the second module 22B also includes lugs 58B that protrude from the base 24B for engagement by one of the latches extending from the base 24A of the first module 22A. Each lug 58B is located proximal a respective side of the hexagonal base 24B, at the outer edge 26B.

Figure 7:
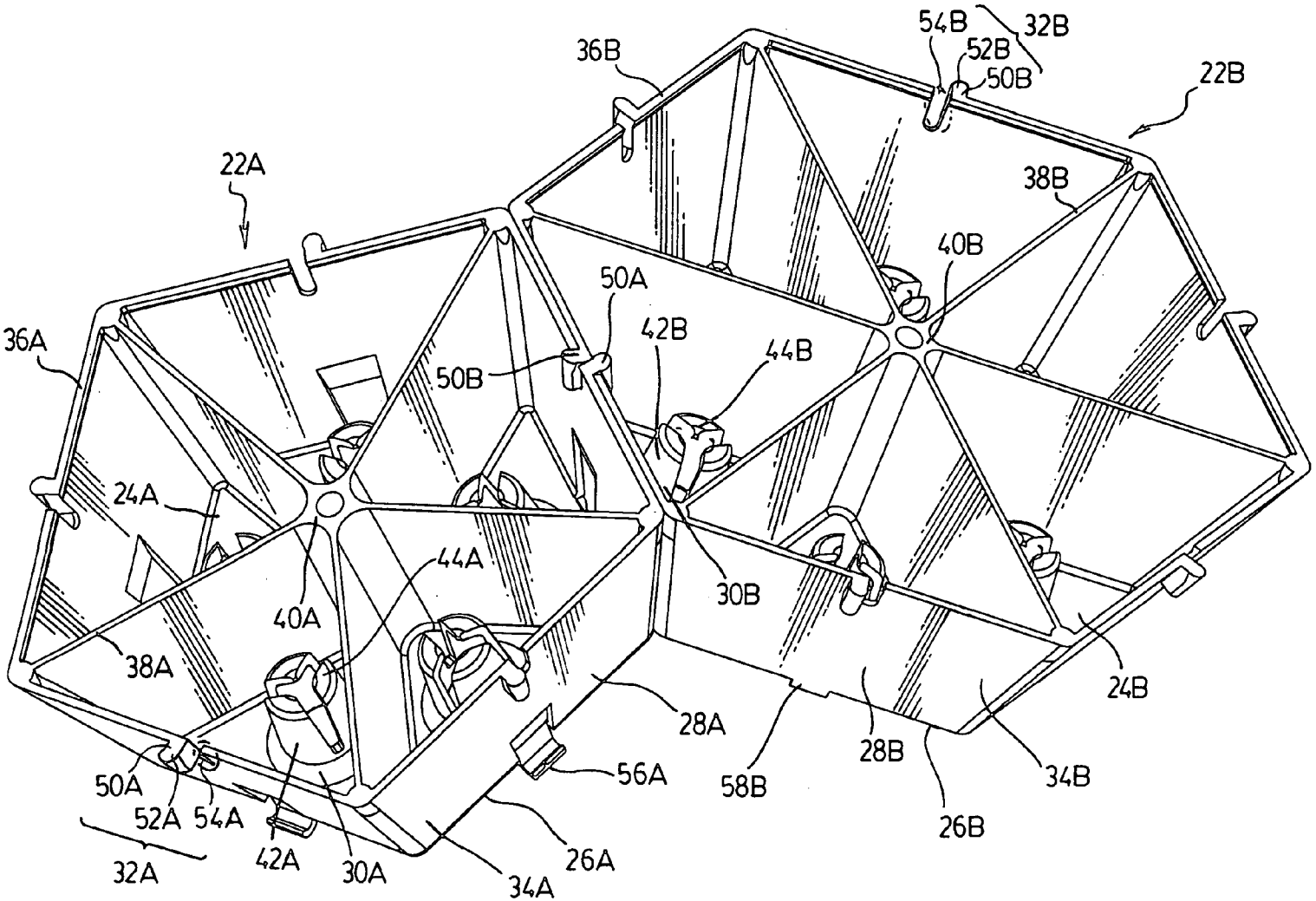
FIG. 7 is a perspective view of a sub-assembly including two modules of the modular lighting assembly of FIG. 1.

When the first and second modules 22A, 22B, respectively, are assembled together, one wall portion 34A of the first module 22A abuts with one wall portion of the second module 22B, as best shown in FIG. 7. Referring to FIGS. 7 and 8, the tab 50A of the first module 22A is received in the slot 54B of the second module 22B when assembled. Similarly, the tab 50B of the second module 22B is received in the slot 54A of the first module. Since the tabs 50A, 50B are sized and shaped to provide an interference fit with the slots, 54B, 54A, respectively, the tabs 50A, 50B snap into slots 54B, 54A, respectively. When assembled, the enlarged locking end 52A of the first module 22A is disposed inside th recess of the second module 22B. Similarly, the enlarged locking end 52B of the second module 22B is disposed inside the recess of the first module 22A. Clearly, these enlarged locking ends 52A, 52B, lock the first and second modules 22A, 22B together and inhibit the wall portion 34A of the first module 22A that abuts with the wall portion 34B of the second module 22B from separating from the wall portion 34B of the second module 22B.

Figure 9:
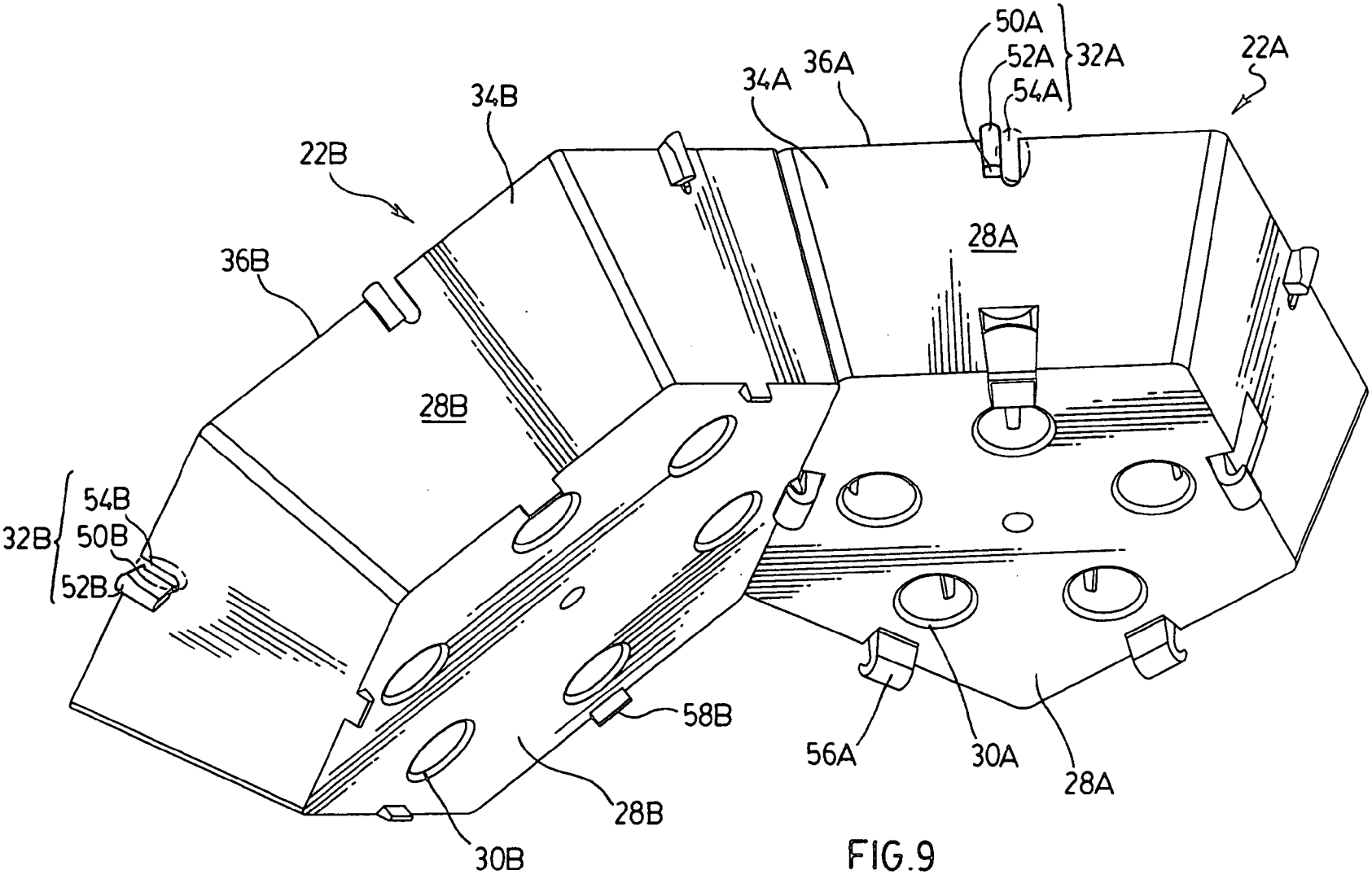
FIG. 9 is an alternative perspective view of the sub-assembly of FIG. 7.

Also, when the first and second modules 22A, 22B, respectively, are assembled together, one of the latches 56A of the first module 22A extends over and engages with one of the lugs 58B of the second module 22B, as best shown in FIGS. 9 and 10. Clearly the engagement of the latch 56A with the lug 58B further ensures that the first and second modules 22A, 22B, respectively, remain assembled.

Figure 11A:
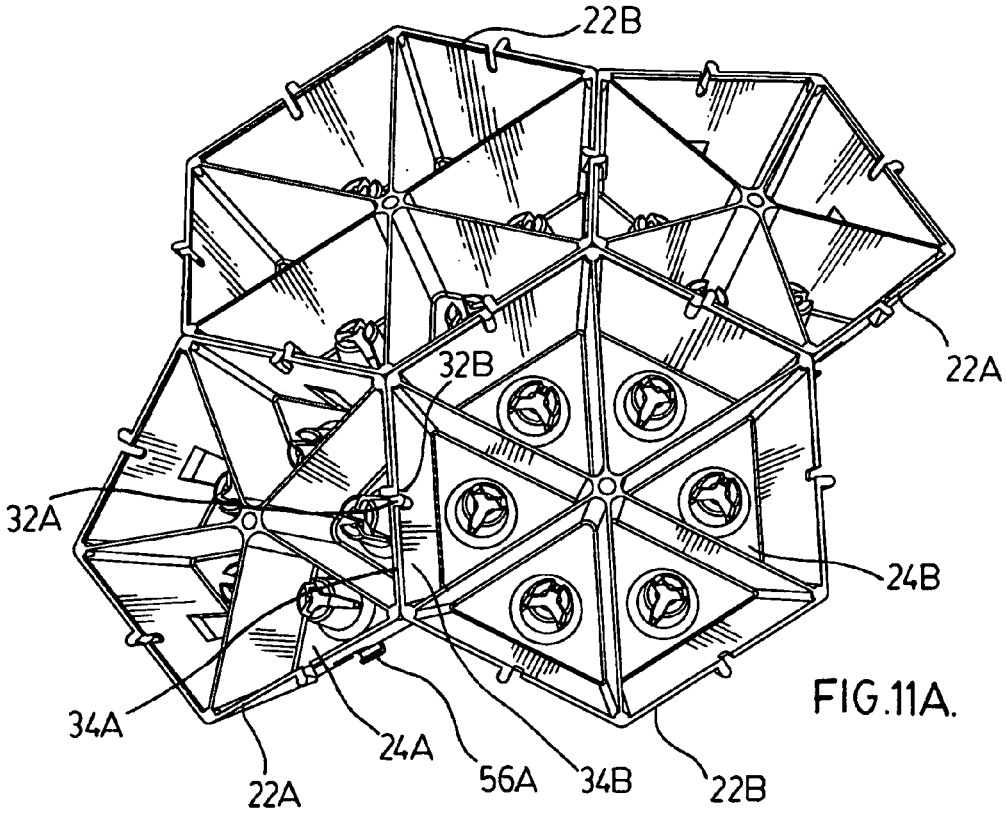
FIGS. 11A and 11B show perspective views of a sub-assembly including four modules of the modular lighting assembly of FIG. 1.
Figure 11B:
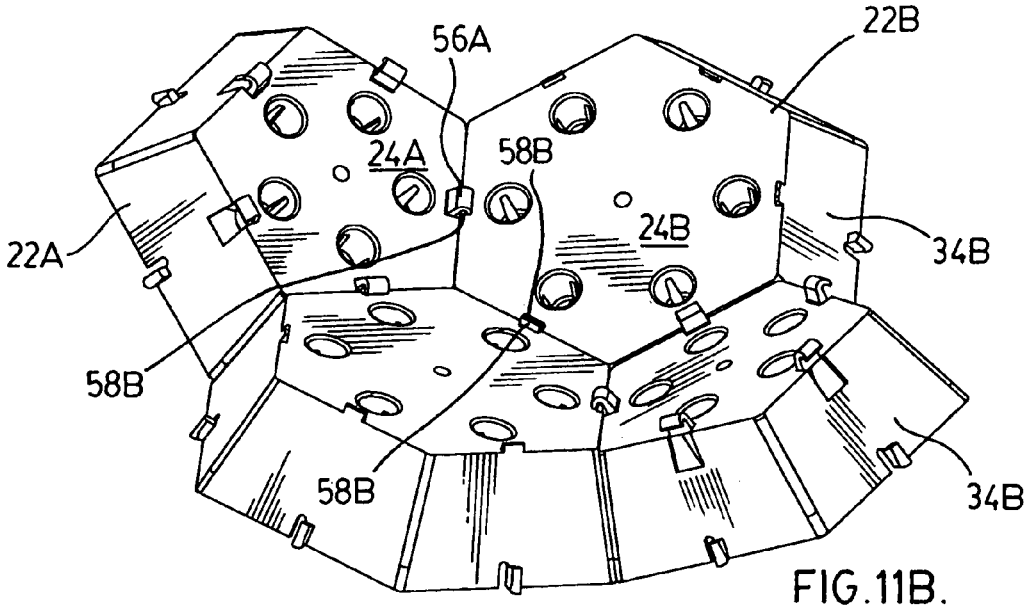

It will be understood from FIG. 1, that in the modular lighting assembly 20 of the present embodiment, three of the wall portions 34B of each second module 22B abut respective wall portions 34A of three first modules 22A. The remaining three wall portions 34B of the second module 22B abut wall portions 34B of other second modules 22B. While the wall portions 34B of abutting second modules 22B lock together by the locking devices 32B provided, the second modules 22B do not include latches. Therefore, along the sides of the outer edge 26 of the bases 24, from which the abutting wall portions 34B extend, two lugs 58B are located adjacent each other, as best shown in FIGS. 11A and 11B.

As previously described, each wall portion 24A forms an obtuse angle with the base 24A and each wall portion 24B forms an obtuse angle with the base 24B. The angled wall portions 24A, 24B cause the bases 24A, 24B to form an angle of less than 180 degrees with respect to each other when assembled. Thus, in the present embodiment, the bases 24A, 24B are not flat with respect to each other. It will be appreciated that this permits joining of the modules 22A and 22B in the shape of the modular lighting assembly 20 shown in FIG. 1.

In the present embodiment, the modules 22 of the modular lighting assembly 20 are comprised of impact modified, UV stabilized acrylic of approximately 1 mm thickness and are each formed by injection molding. Any suitable material and manufacturing process is possible, however.

To assemble the modular lighting assembly of FIG. 1, several first modules 22A and second modules 22B are snap-fit together. With reference to FIGS. 1A and 11B, the modules 22A, 22B are oriented so that one wall portion 34A of the initial first module contacts one wall portion 34B of the initial second module 22B. The modules 22A, 22B are urged together such that the respective locking devices 32A, 32B engage one another and the latch 56A engages the lug 56B. Next, another second module 22B is oriented such that on wall portion 34B contacts one wall portion 34A of the first module 22A and an adjacent second wall portion 34B contacts a wall portion 34B of the initial second module 22B. The modules 22A, 22B, 22B are urged together such that the respective locking devices 32A, 32B and 32B, 32B engage each other. Where the second module 22B abuts the initial first module 22A, the latch 56A engages the lug 58B. It will be apparent that two second modules 22B are locked side by side. In this case, two lugs 58B are disposed side by side and no latch engages either of these lugs.

Disassembly of the assembled modules 22A, 22B is accomplished by forcing the locking devices 32A, 32B apart and disengaging the latch 56A from the lug 58B. To force the locking devices 32A, 32B apart, the tab 50A is forced out of the slot 54B and similarly, the tab 50B is forced out of the slot 54A. A screw driver, for example, is useful for forcing the abutting wall portions 34A, 34B apart and thereby forcing the locking devices 32A, 32B apart.

Figure 12:
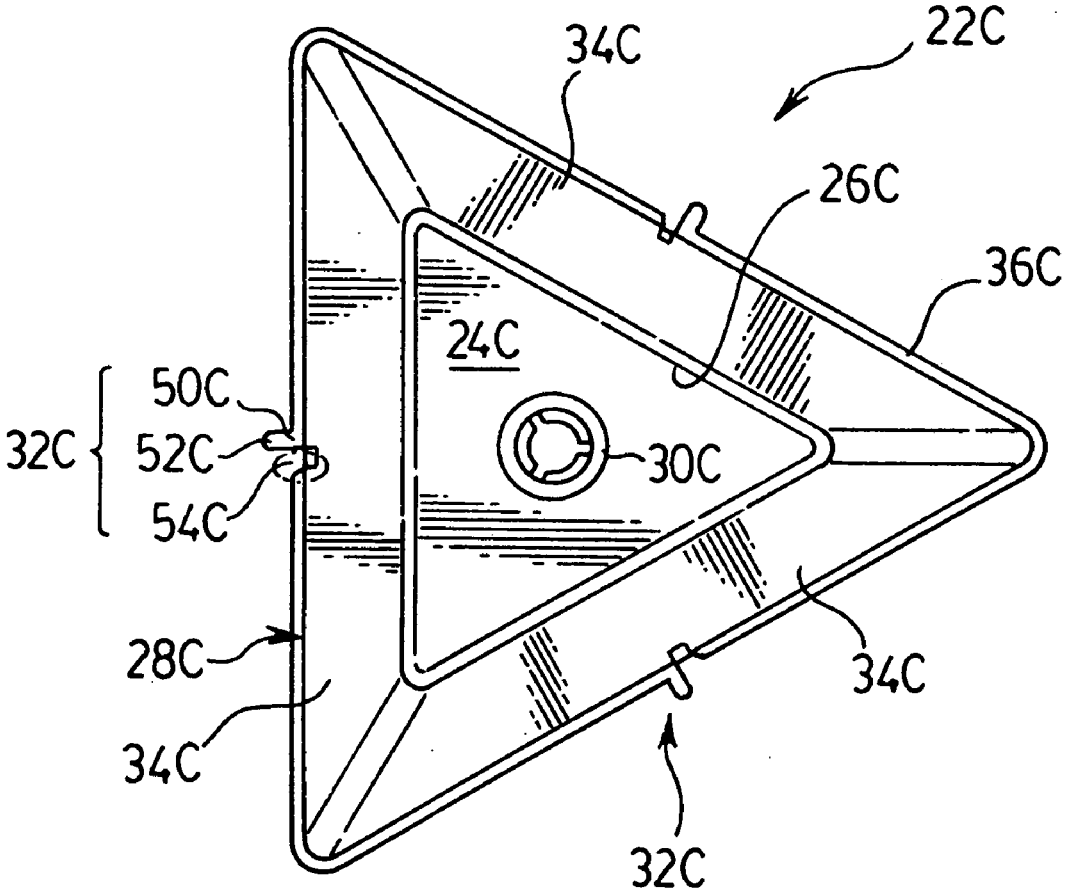
FIG. 12 is a perspective view of another module according to another embodiment of the present invention.

A specific embodiment of the present invention has been shown and described herein. However, other embodiments are possible. FIG. 12 shows another module 22C in accordance with an embodiment of the present invention. The module 22C includes a triangularly shaped base 24C. Thus, the outer edge 26C of the triangularly shaped base 24C includes three sides. Three wall portions 34C together form the sidewall 28C that extends from the outer edge 26C of the base 24C and surrounds the base 24C, forming the recess. Each wall portion 34C extends from a respective one of the three sides of the base 24C to a free side 36C. The free sides 36C of the wall portions 34C together form a triangular opening to the recess formed by the sidewall 28C and base 24C. Similar to the first and second modules 22A, 22B described above, each wall portion 34C forms an obtuse angle with the base 24C as each wall portion 34C extends outwardly therefrom. Thus, the triangular opening formed by the free sides 36C of the wall portions 34C is larger than the triangularly shaped base 24C.

In the present embodiment, the module 22C includes locking devices 32C on each wall portion 34C. These locking devices are similar to the locking devices 32A, 32B, described previously and therefore are not further described herein. It will be understood that the module 22C shown in FIG. 12 can include a latch or a lug (not shown), as previously described with reference to the embodiments of FIG. 2 and FIG. 6, for engagement with a complementary lug or latch of another module.

Because this module has a triangularly shaped base 24C and only three wall portions 34C, no spokes are provided. Also, only one socket 30C extends from the base 24C, into the recess.

Figure 13A:
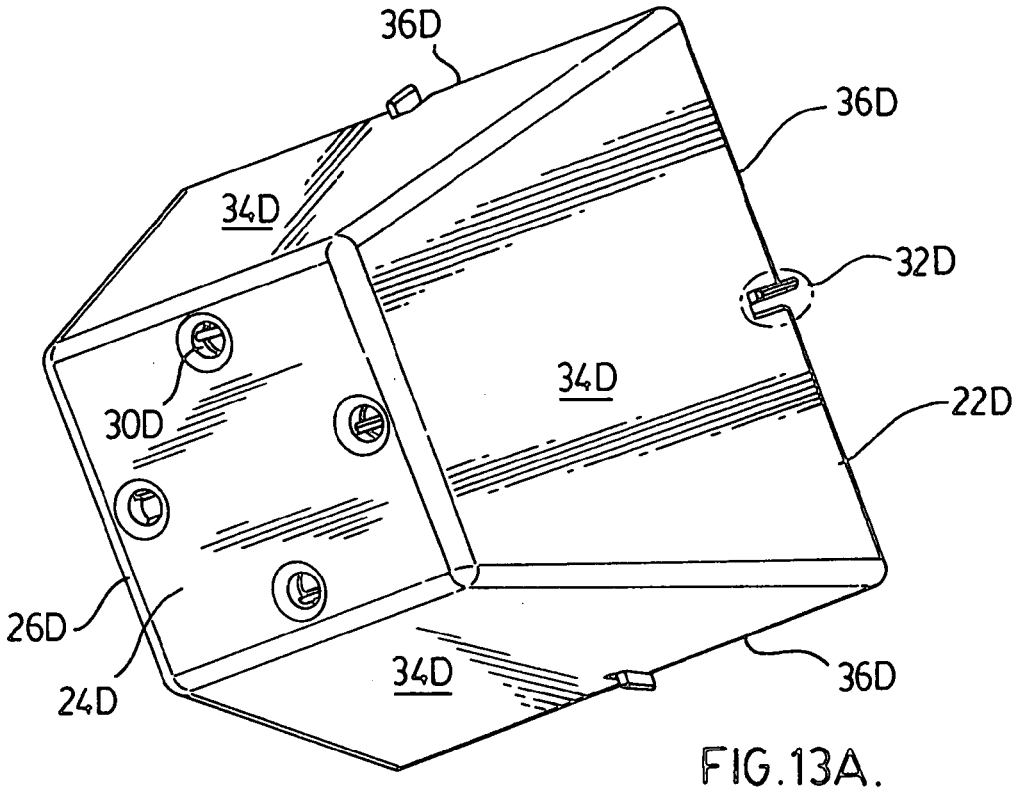
FIGS. 13A and 13B show perspective views of yet another module according to another embodiment of the present invention.
Figure 13B:
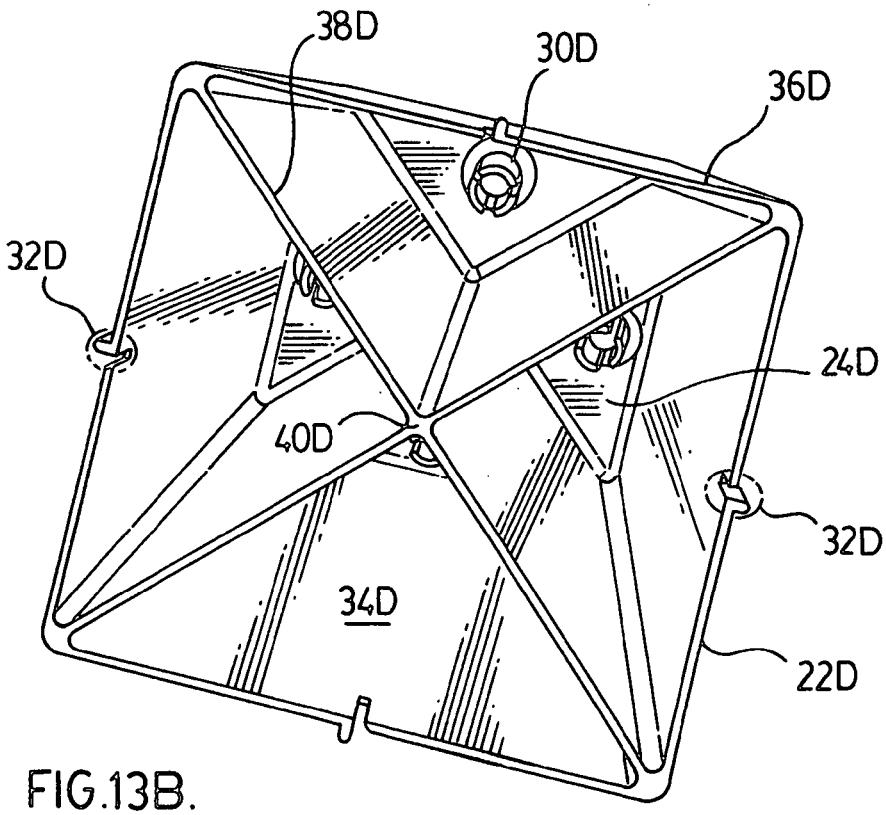

FIGS. 13A and 13B show still another module 22D in accordance with another embodiment of the present invention. The module 22D includes a square shaped base 24D. Thus, the outer edge 26D of the square shaped base 24D includes four sides. Four wall portions 34D together form the sidewall 28D that extends from the outer edge 26D of the base 24D and surrounds the base 24D, forming the recess. Each wall portion 34D extends from a respective one of the four sides of the base 24D to a free side 36D. The free sides 36D of the wall portions 34D together form a square opening to the recess formed by the sidewall 28D and base 24D. Similar to the first and second modules 22A, 22B described above, each wall portion 34D forms an obtuse angle with the base 24D as each wall portion 34D extends outwardly therefrom. Thus, the square opening formed by the free sides 36D of the wall portions 34D is larger than the square shaped base 24D.

In the present embodiment, the module 22D includes locking devices 32D on each wall portion 34D. These locking devices are similar to the locking devices 32A, 32B described previously and therefore are not further described herein. Again, it will be understood that the module 22D shown in FIGS. 13A and 13B can also include a latch or a lug (not shown) for engagement with a complementary lug or latch of another module.

Because this module has a square shaped base 24D and four wall portions 34D, four spokes 38D extend inwardly to the central hub 40D. Thus, the recess of the module 22D is divided into four triangular regions, each region being defined by a wall portion 34D and two spokes 38D. Each of the triangular regions includes a respective socket 30D that extends from the base 24A into the recess.

Figure 14A:
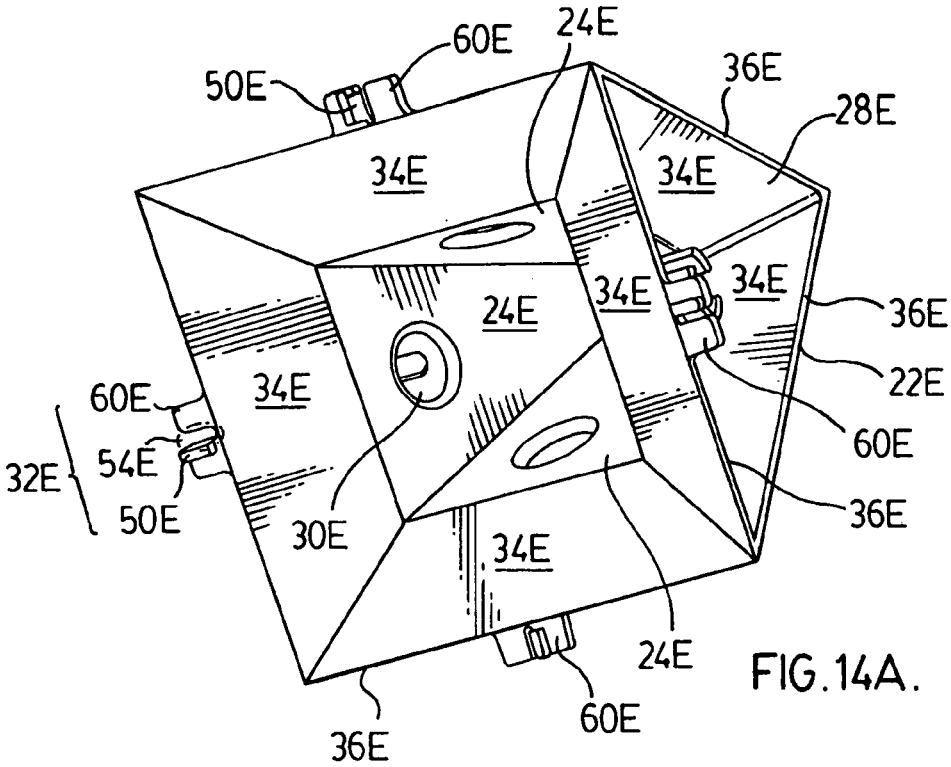
FIGS. 14A and 14B show perspective views of another module according to still another embodiment of the present invention.
Figure 14B:
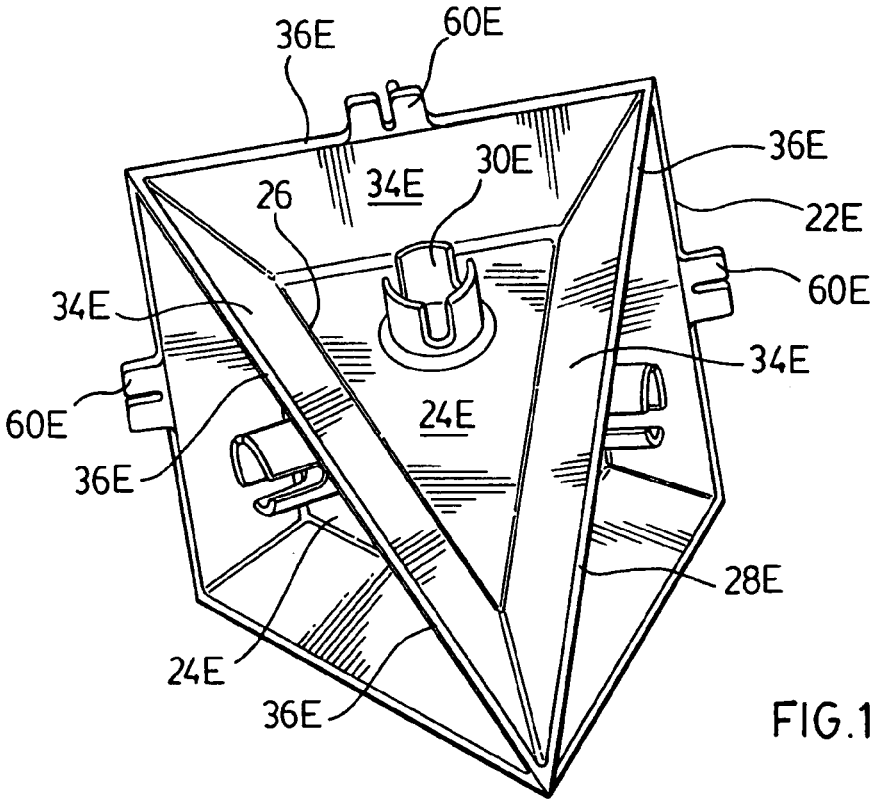

FIGS. 14A and 14B show another module 22E according to yet another embodiment of the present invention. The module 22E of the present embodiment includes for bases 24E, each base 24E being triangular in shape and thus, having three sides. Three wall portions 34E together form a sidewall 28E around each base 24E. It will be appreciated that adjacent bases 24E share a common wall portion 34E. The three wall portions 34E that surround a respective base 24E form one of four triangular recesses. Each wall portion 34E extends from a respective one of the three sides of the base 24E to a free side 36E. The three free sides 36E of the wall portions 34E surrounding a respective base 24E, together form a triangular opening to one of the four triangular recesses. Similar to the previously described modules 22A, 22B, 22C, 22D, each wall portion 34E forms an obtuse angle with the respective base 24E as each wall portion 34E extends outwardly therefrom. Thus, the triangular opening formed by the free sides 36E of the three wall portions 34E surrounding the respective one of the bases 24E is larger than the triangularly shaped base 24E.

In the present embodiment, the four bases 24E and the wall portions 34E are molded together to form a pyramid-shaped recess between the bases 24E.

The module 22E includes locking devices 32E only on four wall portions 34E, that together define four sides of a mouth to the pyramid-shaped recess. Each of the locking devices 32E include a tab 50E with an enlarged locking and 52E and a slot 54E. In the present embodiment, however, rather than extending from the wall portion 34E, each tab 50E extends from a small panel 60E that protrudes from the free side 36E of the wall portion 34E. Similarly, each slot 54E is located in the small panel 60E, adjacent the tab 50E.

Each of the four triangular bases 24E includes a socket 30E that extends from the respective base 24E and into the respective recess.

Since the modules 22A, 22B, 22C, 22D, 22E described, include similar locking devices, they are useful for interconnection with one another regardless of size or shape. As a result, modular lighting assemblies having almost any shape are possible. Also, although the modules described above include sides that form an obtuse angle with the base, it is possible that the sides could form any suitable angle and could be perpendicular with the base.

The many features and advantages of the invention are apparent from the detailed specification and, thus, it is intended by the appended claims to cover all such features and advantages of the invention that fall within the true spirit and scope of the invention. Further, since numerous modifications and changes may occur to those skilled in the art, it is not desired to limit the invention to the exact construction and operation illustrated and described, and accordingly all suitable modifications and equivalents may be resorted to, falling within the scope of the invention.

What is claimed is:

1. A module comprising:

a base having an outer edge;

a sidewall coupled to the outer edge of the base, the sidewall surrounding the base to provide a recess;

a socket coupled to the base for receiving a light bulb;

at least one locking device provided on at least one of the sidewall and the base, the locking device configured to couple with a complementary locking device of a second module for coupling the module with the second module to provide a modular lighting assembly.

2. The module according to claim 1, wherein the base is generally flat and is a polygonal shape and said sidewall includes wall portions, each wall portion corresponding to a respective one of said sides the flat base and extending therefrom.

3. The module according to claim 2, wherein said sidewall is coupled at a first edge to the outer edge of the base and extends therefrom such that an opposing edge of said sidewall defines a polygonal opening to said recess.

4. The module according to claim 3, wherein the number of sides of the polygonal shaped base is equal to the number of sides of the polygonal opening defined by the opposing edge of the sidewall.

5. The module according to claim 4, wherein each of said sidewall portions extends at an obtuse angle from said base such that said polygonal opening is larger than said base.

6. The module according to claim 1, wherein said socket extends into the recess.

7. The module according to claim 1, wherein each socket includes at least two upwardly extending prongs.

8. The module according to claim 7, wherein each prong includes an inwardly projecting end for centering the light bulb when received therein.

9. The module according to claim 1, wherein each of said wall portions includes one of said at least one locking device such that each of said wall portions is configured for coupling with the complementary locking device on a wall portion of the second module.

10. The module according to claim 9, wherein said locking device comprises a tab extending outwardly from a respective sidewall portion, the tab having an enlarged locking end for locking with a complementary slot of the complementary locking device of the second module.

11. The module according to claim 10, wherein said locking device further comprises a slot for receiving a complementary tab of the complementary locking device of the second module.

12. The module according to claim 1, further comprising a latch extending from said base, for engaging with a lug on said second module.

13. The module according to claim 1, further comprising a lug protruding from said base, said lug for engagement by a latch extending from a base of said second module.

14. A modular lighting assembly comprising a plurality of modules coupled together, each module having a base having an outer edge, a sidewall coupled to the outer edge of the base, the sidewall surrounding the base to provide a recess, a socket coupled to the base for receiving a light bulb and at least one locking device provided on the sidewall, the locking device configured for coupling with a complementary locking device of another of said plurality of modules.

15. The modular lighting assembly according to claim 14, wherein the base of each module is generally flat and is a polygonal shape and said sidewall includes wall portions, each wall portion corresponding to a respective one of said sides the flat base and extending therefrom.

16. The modular lighting assembly according to claim 15, wherein the sidewall of each of said modules is coupled at a first edge, to the outer edge of the base and extends therefrom such that an opposing edge of said sidewall defines a polygonal opening to said recess.

17. The modular lighting assembly according to claim 16, wherein the number of sides of the polygonal shaped base of each module is equal to the number of sides of the polygonal opening defined by the opposing edge of the sidewall.

18. The modular lighting assembly according to claim 17, wherein each of said sidewall portions of each module extends at an obtuse angle from said base such that said polygonal opening is larger than said base.

19. The modular lighting assembly according to claim 14, wherein each of said wall portions of each module includes one of said at least one locking device such that each of said wall portions is configured for coupling with the complementary locking device on a wall portion of said other module.

20. The modular lighting assembly according to claim 19, wherein said locking device of each of said modules comprises a tab extending outwardly from a respective sidewall portion, the tab having an enlarged locking end for locking with a complementary slot of the complementary locking device of the second module, the locking device further comprising a slot for receiving a complementary tab of the complementary locking device of said other module.

21. The modular lighting assembly according to claim 14, wherein each of said modules includes one of a latch extending from said base, for engaging with a lug of said other module, or a lug protruding from said base for engagement by a latch extending from a base of said other module.

* * * * *